United States Patent [19]

Bowen

[11] 3,931,804

[45] Jan. 13, 1976

[54] IGNITION CIRCUITS FOR INTERNAL COMBUSTION ENGINES

[75] Inventor: Dennis Dawes Bowen, Wilmslow, England

[73] Assignee: Bowpark Developments Limited, Wilmslow, England

[22] Filed: June 21, 1973

[21] Appl. No.: 372,174

[30] Foreign Application Priority Data

June 22, 1972 United Kingdom ..... 29223/72

[52] U.S. Cl. ..... 123/148 E; 307/10 R

[51] Int. Cl.[2] ..... F02P 1/00

[58] Field of Search ..... 123/148 E, 148 OC; 307/10 R

[56] References Cited

UNITED STATES PATENTS

| | | | |
|---|---|---|---|
| 3,581,725 | 6/1971 | Hemphill | 173/148 E |
| 3,613,654 | 10/1971 | Gilbert | 173/148 E |
| 3,646,926 | 3/1972 | Plume | 173/148 E |
| 3,682,150 | 8/1972 | Ford | 173/148 E |
| 3,710,131 | 1/1973 | Ford | 173/148 E |

*Primary Examiner*—Charles J. Myhre
*Assistant Examiner*—Ronald B. Cox

[57] ABSTRACT

A photo-electronic internal combustion ignition system in which a shutter rotated by the distributor shaft of the engine alternately supplies and cuts light from a photodiode to a photo-electric pickup. The circuit is devised to produce an exceedingly rapid cut-off of current to the engine induction coil, and for this purpose an amplifier following the pickup has a connection to the photo-diode which as soon as the pickup receives a predetermined minimum amount of light via the shutter, momentarily pulses the photo-diode so that the latter produces a short flash of high intensity light. Induction coil cut-off occurs when the photo-diode receives this light flash.

6 Claims, 2 Drawing Figures

IGNITION CIRCUITS FOR INTERNAL COMBUSTION ENGINES

Prior application. In Great Britain dated 22 nd June 1972 and numbered 29223/72.

The present invention relates to an internal combustion engine ignition system and has for its object the elimination of the metal interrupter contacts normally included in such a system.

It is known to provide an induction coil in series with these metal interrupter contacts and a battery, for engine ignition. When the contacts are periodically broken by the engine mechanism, the current in the primary of the induction coil falls rapidly and momentarily produces a high voltage in the secondary of the induction coil. However, an inductive surge occurs in the primary which causes sparking at the contacts. Even though these contacts may be composed of hard metal such as tungsten, this sparking causes the contacts to wear unevenly over a period of time, and this impairs the efficiency of the circuit, since the timing of the high voltage to ignite the fuel-air mixture in the cylinders of the engine with respect to the position of the pistons in the cylinders must be accurately predeterminable for good engine performance. Worn contacts and mechanical wear of the interrupter cam can both contribute to impair engine efficiency by altering the ignition timing.

According to the present invention there is therefore provided an internal combustion engine ignition system comprising a light source, a photo-electric pickup, a shutter moved at a rate proportional to the engine speed to periodically pass and interrupt light from the source to the pickup, amplifier means actuated by the pickup, means connecting the amplifier output to an ignition coil, and a pulse-producing stage in the amplifier so connected to the light source as to momentarily increase the light output thereof to many times greater than normal each time light commences to fall on the pickup and means for interrupting the amplifier output during said momentary light increase.

Reference should now be made to the accompanying drawings, in which.

Figure 1:
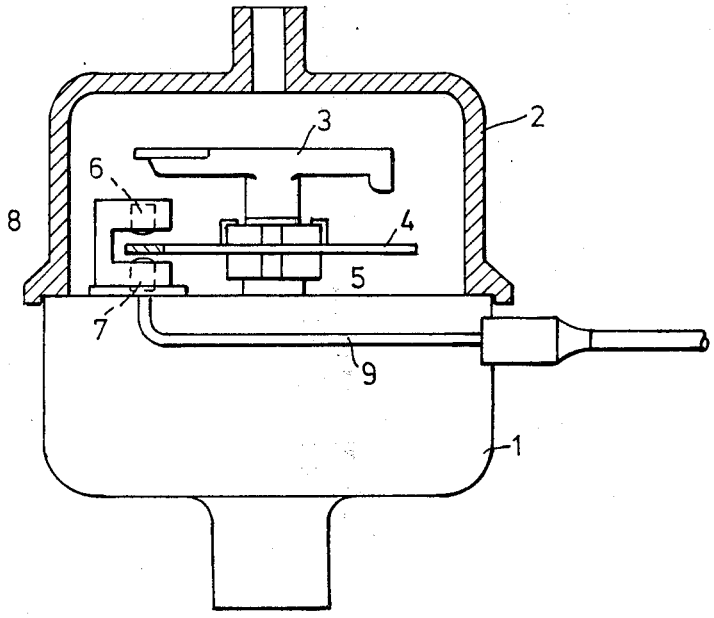
FIG. 1 is a part section of a distributor head incorporating the invention.

Referring to FIG. 1 it will be seen that the distributor consists of a body 1, a cover 2 and a rotor arm 3 all of which may be already fitted on existing automobiles. A gapped shutter 4 is provided and is placed on the distributor cam shaft 5 which is rotated by the engine at an appropriate speed. The shutter is located by the cam with respect to shaft 5 so that it is always in the correct position as regards the firing of the engine.

On one side of the shutter there is a light emitting diode (LED) 6 and a photo-diode or photo-transistor 7 on the other side, both mounted on a common block 8 located inside the distributor. A convenient space for this block is the space normally occupied by the condenser used in an ordinary ignition system. Connections from the block are then taken via a cable 9 to the amplifier in FIG. 2. Timing of the operation of the device with respect to the pistons is effected by rotating the distributor with regard to its support, or by using a screw adjuster. The block 8 is carried on a part of the distributor which is itself rotatable with the head so that adjustment of the timing of the device is effected similarly to that of a normal contact breaker.

Figure 2:
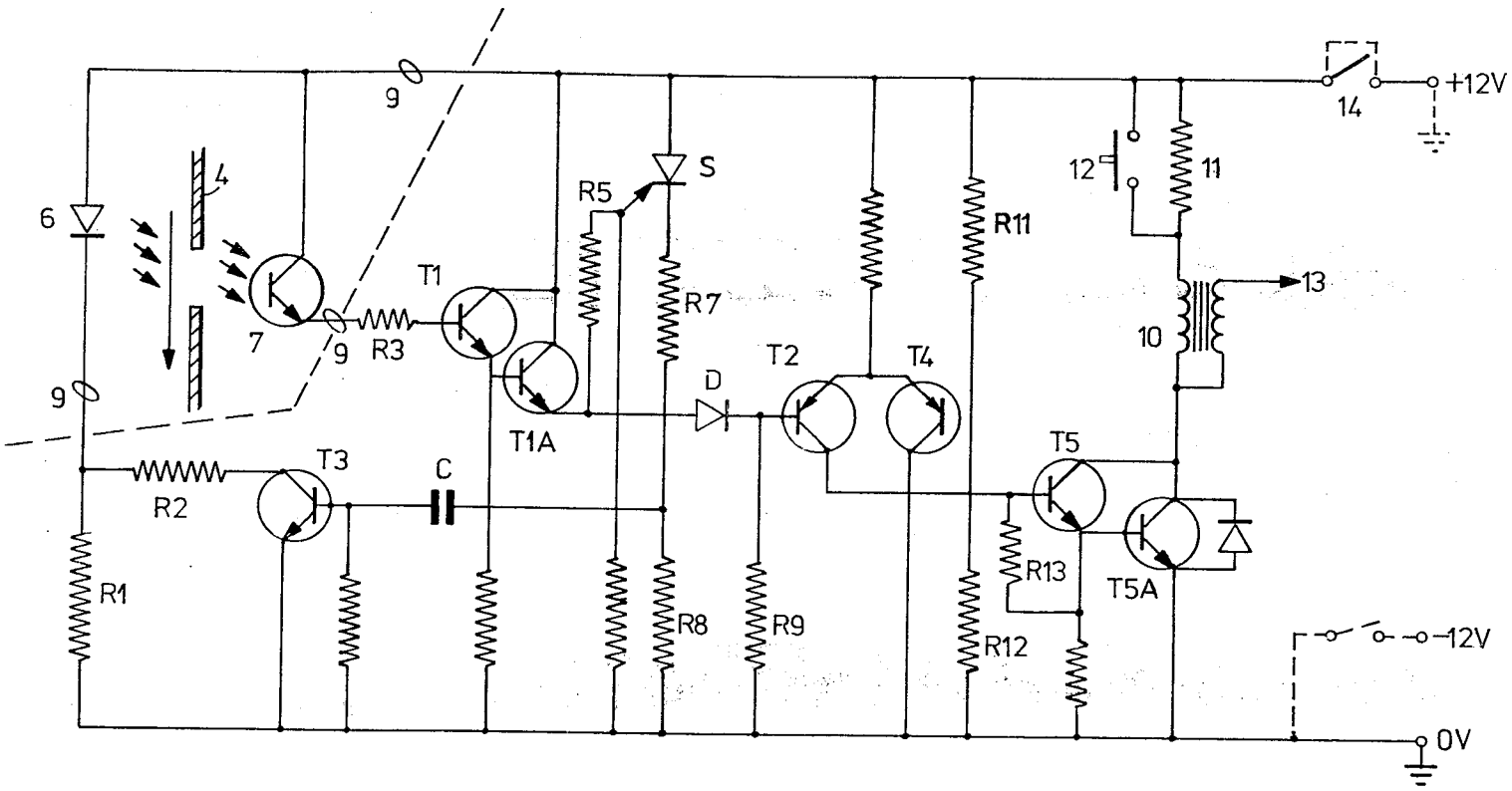
FIG. 2 is an associated ignition system and switching amplifier circuit.

From FIG. 2 it will be seen that the apparatus surrounded by the dotted line is located in the distributor itself and consists of the LED, the photo-diode and the shutter only. The LED normally carries a small current limited by resistor R1, so that its light output is normally low, though adequate. The photo-diode output is connected to a Darlington pair amplifier T1, T1A. When the shutter intervenes between the LED and photo-diode, there is no output from the T1A emitter, T2 transistor is made fully conducting by R9, and current from T2 via R13 causes the power Darlington pair T5, T5A to conduct also. Transistor T5A is capable of carrying and interrupting several amperes and is connected to one end of the primary 10 of the ignition coil. If this ignition coil is wound for the voltage supplied by the battery of the car, then the other end of the primary is connected direct to the battery. If not, then a dropper resistor 11 is inserted in series with the coil, this resistor being shorted out by a switch 12 during starting so as to give maximum output from the coil secondary (cold start facility). The output of the coil is taken via lead 13 to the rotor arm 3 in the distributor as shown in FIG. 1.

In FIG. 2 the car battery is shown as having an earthed negative. If however, the car uses a positive earthed battery, then the dotted connections shown are alternatively followed. The switch 12 or 14 is the ignition switch.

When the photo-diode 7 is progressively subjected by the shutter to the light from the LED 6, its resistance falls and the T1, T1A combination starts to turn on. As previously stated, T2 is fully conducting, and its base voltage reverse biasses diode D. As T1A emitter voltage rises above on volt, thyristor S strikes via R5 and applies a positive pulse of very short duration from the potential divider R7, R8 to T3 base via capacitor C. This momentarily shunts resistor R1 with a low value resistor R2, pulsing the LED to produce many times its normal light output for a few microseconds. The resultant positive light feedback avalanches T1, T1A to the fully conducting state and hence turns off T2. As soon as the reference potential on T4 base derived from potential divider R11, R12 is exceeded by the potential on its emitter which occurs during the said few microseconds, this double emitter-follower stage switches to T2 off, T4 on, so that T5 and T5A switch to the off stage. T5A very rapidly interrupts the current through the primary to the ignition coil, and causes a high voltage surge to appear on the lead 13.

When the light from the LED to the photo-diode PT is cut off once more by the shutter, the circuit returns to its previous condition wherein T5 and T5A conduct, the latter causing current to build up once more in the primary of the induction coil, ready for the next spark-producing action.

Although it has been said that the shutter 4 is provided with gaps and that these allow light from the light source LED to fall on the photo-diode PT as the shutter moves, it should be realised that the shutter may include reflecting and non-reflecting areas, whereby the light from the LED is either reflected back from parts of the shutter onto the photocell PT, or absorbed. This arrangement would have the advantage of presenting a non-gapped surface, and also would allow both the photocell and the light producing device to be included within the screen, thus protecting the light source and the photo-diode from dust, dirt or oil fumes.

Again, the thyristor may be replaced by any other suitable rapid-change-over device such as a mono- or bi-stable circuit.

We claim:

1. An internal combustion engine ignition system comprising a light source, a photo-electric pickup, a shutter moved at a rate proportional to the engine speed to periodically pass and interrupt light from said source to said pickup, amplifier means actuated by said pickup, means connecting said amplifier output to an ignition coil, a pulse-producing stage in said amplifier connected to said light source so as to momentarily increase the light output thereof to at least two times greater than normal each time light commences to fall on said pickup, and means for interrupting the amplifier output during said momentary light increase to thereby switch ignition coil current off with increasing light output.

2. An ignition system as recited in claim 1, wherein said shutter defines a plurality of gaps interspersed with light-blocking portions, said light source is located on one side of said shutter and said photo-electric pickup is located on the other side of said shutter.

3. An ignition system as recited in claim 1, wherein said shutter is provided with a plurality of areas which are alternately reflecting and non-reflecting, and said light source and said pickup are located on the same side of said shutter.

4. An ignition system as recited in claim 1, wherein said light source is a light emitting diode and said pickup is a photo-diode.

5. An ignition system as recited in claim 1, wherein said pulse-producing stage includes a thyristor connected to conduct as soon as the light falling on said pickup reaches a predetermined value, a transistor pulsed to a conducting condition when said thyristor conducts, and a connection from said transistor to said light source to cause said source to momentarily increase the current through said source and hence the light output of said source.

6. An ignition system as recited in claim 1, including an emitter-follower in said amplifier, the output of which changes rapidly from one conductive condition to another when said pickup is illuminated, and a power output transistor following said emitter-follower and controlled thereby, also to change its conductive condition rapidly.

* * * * *